United States Patent [19]

Sugioka

[11] Patent Number: 4,657,205

[45] Date of Patent: Apr. 14, 1987

[54] GUIDE DEVICE FOR SEPARATING A PLURALITY OF YARN PASSAGES

[75] Inventor: Takami Sugioka, Matsuyama, Japan

[73] Assignee: Teijin Seiki Co., Ltd., Osaka, Japan

[21] Appl. No.: 872,247

[22] Filed: Jun. 9, 1986

[30] Foreign Application Priority Data

Jun. 18, 1985 [JP] Japan ..... 60-092006[U]

[51] Int. Cl.[4] ..... B65H 57/16; B65H 57/28; D01H 13/04

[52] U.S. Cl. ..... 242/157.1; 57/90; 57/352; 57/358; 57/359; 242/157 R

[58] Field of Search ..... 57/352, 358–361, 57/90, 91; 242/157 R, 157 C, 157.1, 158 R, 158 B

[56] References Cited

U.S. PATENT DOCUMENTS

| | | | |
|---|---|---|---|
| 2,614,382 | 10/1952 | Hoffmann | 57/360 |
| 2,795,925 | 6/1957 | Parker et al. | 57/352 X |
| 3,113,413 | 12/1963 | Jacobs et al. | 57/91 X |
| 3,344,595 | 10/1967 | Johnson | 57/358 X |

FOREIGN PATENT DOCUMENTS

| | | |
|---|---|---|
| 57-174462 | 11/1982 | Japan . |
| 57-174463 | 11/1982 | Japan . |

*Primary Examiner*—John Petrakes

*Attorney, Agent, or Firm*—Burgess, Ryan & Wayne

[57] ABSTRACT

A guide device (20) for separating a plurality of yarn passages comprising:

a rod member (24) movable in its lengthwise direction;

a plurality of slide members (**25*a*–25*d*), provided with yarn guides (22) and movable along the rod member (24**);

the rod member (24) and the slide members (**25*a*–25*d*) are inserted into and movable along a hollow cylindrical guide rail member (21**);

the rod member (24) having at least a pair of guide pulleys (30), which sandwich the slide members (**25*a*–25*d***) between them;

a strand-like member (28) wrapping around the guide members (30);

the strand-like member (28) is connected to one of the slide members (**25*a*–25*d***) and a stationary member;

connecting members (26) having engaging members (**25*b*) at ends thereof are loosely inserted between adjacent slide members (25*a* and 25*b*, 25*b* and 25*c*, 25*c* and 25*d*); and the distance between the engaging members (26*b*) of the connecting member (26) is equal to the sum of the distance between the yarn guides (22**) under yarn passages separating condition and the thickness of the slide member.

The yarn guide (22) located at the front end of the rod member (24) is moved a distance equal to or more than twice of the moving distance of the rod member (24), when the rod member (24) is moved. The rod member (24) does not project excessively from the front surface of the machine frame, and accordingly, the operating ability of an operator around the textile machine is increased, and the guide device for separating a plurality of yarn passages is not damaged while it is operated.

8 Claims, 7 Drawing Figures

GUIDE DEVICE FOR SEPARATING A PLURALITY OF YARN PASSAGES

DETAILED DESCRIPTION OF THE INVENTION

BACKGROUND OF THE INVENTION

This invention relates to a guide device for separating a plurality of yarn passages. More specifically, the present invention relates to a guide device for separating a plurality of yarn passages in so called multi-cops textile machines, such as a spinning and winding apparatus of synthetic yarns or a rewinding apparatus, wherein a plurality of yarns are simultaneously wound on a plurality of packages supported on a common winding chuck.

PRIOR ART

When a plurality of yarns are simultaneously wound on a plurality of packages supported on a common winding chuck in such a multi-cops textile machine, filaments constituting the yarns must be prevented from being entangled with neighboring yarns. In order to achieve this end, conventionally, yarn guides are securely disposed at a predetermined distance so as to space guided yarns at a predetermined distance.

However, when yarn guides are fixed at a predetermined distance as described, upon threading operation, an operator must extend his hand from the front surface of the textile machine to the inner portion far from the operator in order to thread yarns on the bobbins inserted on the common winding chuck. Accordingly, the threading operation is very troublesome.

PROBLEMS TO BE SOLVED BY THE INVENTION

In order to obviate the above-described problem, Japanese Utility Model Application Laid-open No. 57-174462 discloses a device, wherein a yarn guide mounting bar is slidably disposed relative to a yarn guide box, a first yarn guide is fixed at a front end of the yarn guide mounting bar and a second yarn guide is slidably disposed on the yarn guide mounting bar.

According to this device, when the yarn guide mounting bar is pulled, the first yarn guide is moved toward the front surface of the machine frame so as to near the second yarn guide. Under this condition, yarns which are held by a yarn aspirating device are thread onto the yarn guides. After the threading operation has been completed, the yarn guide mounting bar is pushed again to as to move the first yarn guide to the predetermined position at the interior of the machine frame. Accordingly, the distance between the first yarn guide and the second yarn guide becomes a predetermined amount.

However, this device has a disadvantage that the yarn guide mounting bar has to be moved a long distance, which is substantially equal to the distance between a position at the interior of the machine frame, where the yarn guide originally locates, to a position near the front surface, where the pulled yarn guide locates.

Recently, the number of bobbins inserted on a common winding chuck is increasing, and the length of a yarn package is also increasing, for example, a bobbin holder having a length of 1200 mm is used to simultaneously wind eight packages. As a result, the threading guide is required to be moved about 1100 mm. Accordingly, when the yarn guide mounting bar is pulled, the rear end of the yarn guide mounting bar remarkably projects from the yarn guide box. Thus, an operating space around the yarn guide box is narrowed. In order to overcome the above-described narrowing, a large operating space has to be spared so as to prevent operating ability from being decreased.

There is another problem that the yarn guide mounting bar may be bent when the yarn guide bar, which has been pulled outwards, is pushed again into the guide box, unless they are sufficiently in parallel with each other.

In Japanese Utility Model Application Laid-open No. 57-174463, a yarn guide box has cylinders and a yarn guide mounting bar telescopically mounted therein. The yarn guide mounting bar is pulled and pushed so that the distance between the yarn guides is widened to a predetermined amount and is narrowed. The problems similar to those inherent to Japanese Utility Model Application Laid-open No. 57-174462 described above also occur in the device disclosed in Japanese Utility Model Application Laid-open No. 57-174463. More specifically, according to this device, when the yarn guide mounting bar is pulled, the rear end of the yarn guide mounting bar remarkably projects from the yarn guide box. Thus, the operating ability of an operator around the textile machine wherein a plurality of yarns are wound on packages inserted on a common winding chuck is decreased. Further, there is another problem that the yarn guide mounting bar may be bent when the yarn guide bar, which has been pulled outwards, is pushed again into the guide box, unless they are sufficiently in parallel with each other.

OBJECTS OF THE INVENTION

An object of the present invention is to provide a guide device for separating a plurality of yarn passages, by which the above-described disadvantages inherent to the conventional apparatuses can be obviated.

Another object of the present invention is to provide a guide device for separating a plurality of yarn passages, wherein the distance for moving an operating member for actuating a yarn guide may be equal to or less than one half of the moving distance of the yarn guides. Accordingly, the rear end of the yarn guide mounting bar projects from the yarn guide box by a distance less than that in the conventional apparatuses. Thus, the operating ability of an operator around the textile machine is increased. Besides, the yarn guide mounting bar is not damaged while it is operated. Further, the yarn guides can be spaced at a predetermined distance when yarns are ordinary taken up, and they can be close to each other when yarns are threaded thereonto.

SUMMARY OF THE INVENTION

According to the present invention, the above-described objects are achieved by a guide device for separating a plurality of yarn passages comprising:

- a rod member movable in a lengthwise direction thereof;
- a plurality of slide members, provided with yarn guides and movable along the rod member;
- the rod member having at least a pair of guide members, which sandwich the slid members therebetween;
- a strand-like member wrapping around the guide members; and the strand-like member is connected to one of the slide members and a stationary member.

According to the present invention, the guide members are moved in a lengthwise direction of the rod member together with the rod member, and at this time, the strand-like member, a portion of which is secured to a stationary member and which is wrapped around the guide members, moves a distance equal to or more than twice the moving distance of the rod member. Since the guide members are moved by the movement of the strand-like member, the yarn guides can be moved a predetermined distance even when the rod member is moved a small distance, for example, about one half of the whole distance required for the yarn guides.

BRIEF DESCRIPTION OF THE DRAWINGS

The present invention will now be explained with reference to the attached drawings illustrating some embodiments of the present invention, wherein.

PREFERRED EMBODIMENTS

Figure 1:
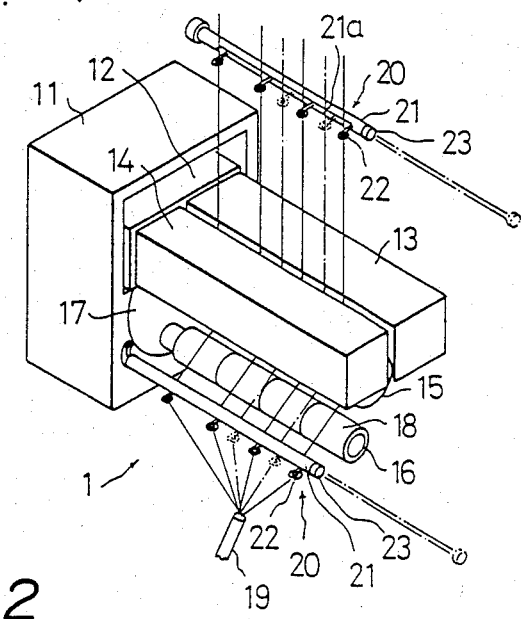
FIG. 1 is a perspective view of a yarn winding apparatus of an automatic bobbin changing type, wherein the present invention is carried out.

Referring to FIG. 1, which is a perspective view of a yarn winding apparatus of an automatic bobbin changing type, wherein the present invention is carried out, the projecting condition of a yarn guide mounting bar of the above-described conventional apparatus is designated by a dot and a dash line.

The yarn winding apparatus 1 of an automatic bobbin changing type comprises a main body 11 of the winding apparatus 1. A slide block 12 is vertically movable along the main body 11 of the winding apparatus 1 and has a traverse box 13 and a case 14 projecting therefrom.

The traverse box 13 has traverse guides (not shown) for traversing yarns to and fro. The case 14 has a friction roller 15 rotatably supported thereby. The main body 11 of the winding apparatus 1 has a turret 17 mounted thereon which is rotatable by 180°. The turret 17 has two chucks 16 rotatably mounted thereon, onto which a plurality of bobbins 18, eight bobbins in the illustrated embodiment, can be inserted.

A guide device 20 for separating a plurality of yarn passages of the present invention is disposed above the traverse box 13 and the case 14 of the yarn winding apparatus 1 of an automatic bobbin changing type. Another guide device 20 for separating a plurality of yarn passages of the present invention is also disposed below the case 14.

Figure 2:
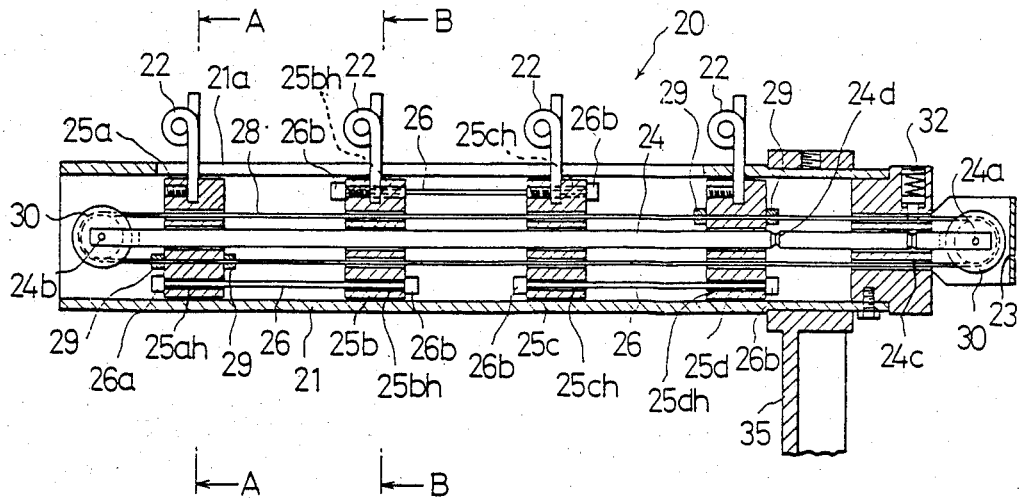
FIG. 2 is a cross sectional side view of a guide device for separating a plurality of yarn passages according to the present invention.
Figure 3:
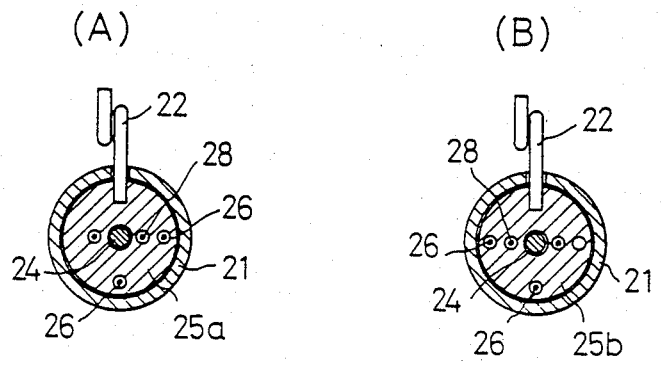
FIGS. 3(A) and (B) are cross sectional views taken along lines A—A and B—B in FIG. 2, respectively.

The guide device 20 for separating a plurality of yarn passages comprises a guide rail member 21, which is constructed with a hollow cylinder and is parallel with the traverse box 13 and the case 14, and a rod member 24, which is inserted into the guide rail member 21 as illustrated in FIGS. 2, 3(A) and (B) and is supported slidably in the lengthwise direction thereof. The guide rail member 21 has a slit 21*a* formed in the lengthwise direction thereof.

When the guide rail member 21 is formed by a hollow cylinder and the rod member 24 is inserted into the guide rail member 21, the device can be compact. However, the guide rail member 21 and the rod member 24 may be disposed in parallel with each other.

As illustrated in FIG. 2, the length of the rod member 24 is made longer than the whole distance between the yarn guides 22 located at the operating position wherein a plurality of yarn passages are separated from each other. The back end 24*a* of the rod member 24 projects outwardly from the frame 35. The end portion of the rod member 24 projecting outwardly from the frame 35 has a grip 23 integrally formed therewith, which is used to move the rod member 24 in the lengthwise direction thereof.

The front end 24*b* of the rod member 24 and the back end 24*a* of the rod member 24 projecting outwardly from the frame 35 have guide pulleys 30, respectively, rotatably supported thereon, which are embodiments of the guide members of the present invention. The guide pulleys 30 sandwich a plurality of slide members 25*a* to 25*c* therebetween. The plurality of the slide members 25*a* to 25*c* have axial openings which are loosely inserted onto the rod member 24 and are movable along the rod member 24 and the guide rail member 21. The slide member 25*d* located near the front surface of the machine frame is secured to the guide rail member 21 by a bolt (not shown). The yarn guides 22 are fixed to the slide members 25*a* to 25*d* and project from the above-described slit 21*a* formed on the guide rail member 21. The material of the yarn guides 22 may be the same as that used for conventional yarn guides.

The slide member 25*d* may be fixed to a stationary member, such as the machine frame 35, other than the guide rail member 21.

A strand-like member 28, which is made of a flexible material and has resistance against elongation, such as a rope, a wire, chains or a string, is wrapped around the guide pulleys 30. The strand-like member 28 is passed through pairs of small holes formed in the slide members 25*a* to 25*d* to form a closed loop, and the ends are connected to each other so as to form an endless loop. The strand-like member 28 is secured by clasps to the slide members 25*a* and 25*d* located at the ends.

Connecting members 26 connect the slide member 25*a* and the slide member 25*b*, the slide member 25*b* and the slide member 25*c*, and the slide member 25*c* and the slide member 25*d*. The connecting member 26 illustrated in FIG. 2 is formed by a bar, such as a piano wire, and is passed through small holes 25*ah* to 25*dh* formed in the slide members 25*a* to 25*d*. Solderless terminals are inserted onto the ends of the connecting members 26 to form stops 26*a* and 26*b*. The distance between the stops 26*a* and 26*b* is set equal to the sum of the distance between the adjacent yarn guides 22 under the ordinary winding condition, the yarn passages designated by solid lines in FIG. 1, and the thickness of the slide member 25 measured in the lengthwise direction of the guide rail member 21. Furthermore, as illustrated in FIGS. 3(A) and (B), the positions of the small holes are displaced in a circumferential direction of the slide members 25*a* to 25*d*, so that the adjacent connecting members 26 are prevented from being collided with each other. The connecting member 26 may be made of a strand which is flexible and which has a predetermined length.

A plunger 32 biased by a spring is disposed in a small recess formed in a stationary member, such as the frame 35. The rod member 24 has two circumferential grooves 24*c* and 24*d* formed on the surface thereof and spaced from each other by a distance equal to one half of the moving stroke of the slide member 25*a* located at the front end. When the rod member 24 is moved forwardly, the plunger 32 engages with the groove 24*c* and secures the rod member 24 at the forwarded position. When the rod member 24 is moved backwardly, the plunger 32 engages with the groove 24*d* and secures the rod member 24 at the backward position.

Since the strand-like member 28, which is wrapped around the guide pulleys 30, is connected to the slide member 25*d*, which is secured to the guide rail member 21, and the slide member 25*a*, which is movable along the guide rail member 21, the guide pulleys 30, as well as the rod member 24, are moved backwardly toward the front surface of the winding apparatus when the grip 23 is pulled outwardly, i.e., to the right in FIG. 2, upon the threading operation. Then, the upper and lower portions of the strand-like member 28 wrapped around the guide pulley 30 are also pulled to the right together with the rod member 24. Further, the guide pulleys 30 are rotated in a counter-clockwise direction in FIG. 2. With the rotation of the guide pulleys 30, the portion of the strand-like member 28 located at the upper side of the guide pulley 30 passes by the guide pulley 30 and moves to the lower side.

Since the strand-like member 28 is wrapped around a pair of guide pulleys 30 in the present embodiment, the slide member 25*a*, which is located at the front end of the rod member 24 and which is connected to the strand-like member 28, is moved a distance which is twice as much as the moving distance of the rod member 24. Accordingly, the yarn guide 22 of the slide member 25*a* located at the front end moves at a speed which is twice as much as the moving speed of the rod member 24 and nears the yarn guide 22 fixed to the stationary slide member 25*d*.

When the slide member 25*a* moves toward the front surface of the machine frame, the connecting members 26 slide within small holes formed in the slide members 25*a* to 25*d*. Accordingly, the slide members 25*a* and 25*d* near each other.

Under this condition, a plurality of yarns Y are sucked together into a suction gun 19 (FIG. 1) and are readily threaded onto the yarn guides 22.

Contrary to this, when the rod member 24 is pushed and is moved in a reverse direction, the slide member 25*a* is moved together with the strand-like member 28 toward the interior of the winding machine at a speed which is twice as much as the moving speed of the rod member 24. As the slide member 25*a* moves, the engaging portions 26*a* and 26*b* of the connecting member 26, which are inserted into the slide members 25*a* and 25*b*, engage with the slide members 25*a* and 25*b*. Thus, the distance between the slide members 25*a* and 25*b* becomes a predetermined distance. Similarly, the distance between the adjacent slide members 25*b* and 25*c*, and the distance between the adjacent slide members 25*c* and 25*d* become a predetermined amount. Accordingly, the yarn guides 22 are located at the ordinary winding position designated by solid lines in FIG. 1, and the yarns Y travel along the yarn passages in an ordinary winding condition.

In the above-described embodiment, the rod member 24 has a pair of guide pulleys 30, which are the guide members of the present invention, at the ends thereof. However in another embodiment, a plurality of pairs of guide pulleys may be disposed, and a strand-like member may be wrapped around the guide pulleys. According to this construction, the moving distance of the strand-like member can be increased to several times, i.e, twice the number of pairs of the guide pulleys, of the moving distance of the rod member 24. In this case, the guide pulleys, which guide the strand-like member to the slide members located at both the ends, have to be located outside of the slide members located at both the ends. However, the other guide pulleys may be located inside of the outermost guide pulleys.

In the above-explained embodiment, the ends of the strand-like member 28 are connected to each other to form an endless loop. However, the ends of the strand-like member 28 may be connected to the sides of the slide member 25*a* or 25*d*.

Further, the strand-like member 28 may be connected to a stationary member other than the slide member 25*d*. In this case, a portion of the strand-like member 28, which portion is always sandwiched by the guide members located at the ends of the rod member 24 when the rod member 24 is move in a lengthwise direction, is connected to the stationary member, and a portion symmetrically located to the connected portion is connected to the slide member 25*a* located at the front end of the rod member 24.

In the above-described embodiment, the guide pulleys 30 of a roller type are rotatably supported on the ends of the rod member 24. In another embodiment, stationary guides having chamferred round portions for engaging with the strand-like member 28 may be used so that the strand-like member 28 slides over the round portions. When chains are used as a strand-like member 28, sprockets may be used as the guide members.

In the present embodiment, the yarn guides 22 are engaged with the slit 21*a*, i.e., the guide groove, formed in the guide rail member 21 so as to avoid the rotation of the yarn guide about the longitudinal axis of the rod member 24. The slide members 25*a* to 25*c* may have pins projecting therefrom, which engage with the guide groove.

Figure 4:
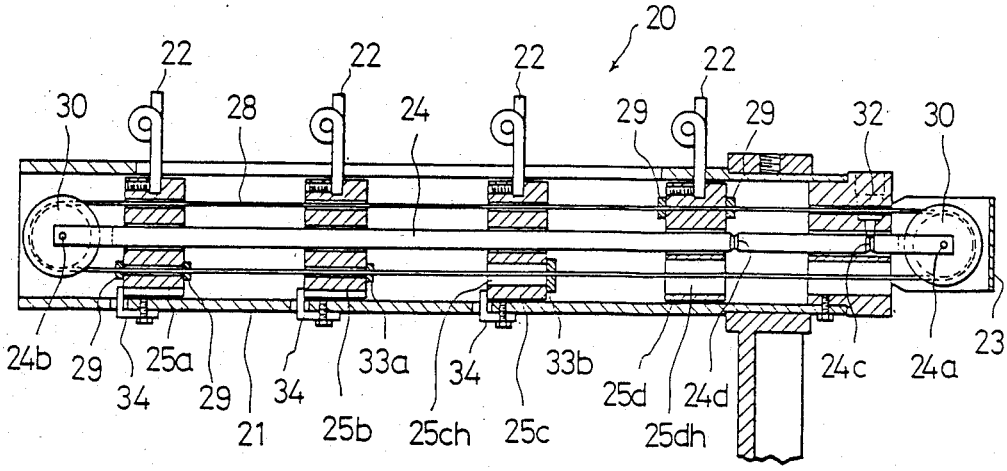
FIGS. 4 and 5 are cross sectional views of other embodiments of the present invention.

In addition, in the above-described embodiment, the connecting members 26 are loosely inserted into the slide members 25*a* to 25*d*, and the solderless terminals are fixed to the ends of the connecting members 26. In place of the connecting members 26, which are prepared independent from the strand-like member 28, the strand-like member 28 may also be used as a connecting member as illustrated in FIG. 4. More specifically, the strand-like member 28 has a plurality of clasps for positioning the intermediate slide members 25*b* and 25*c* at a predetermined distance between the yarn guides under the yarn passages separating condition. Further, the guide rail member 21 has stops 34 for positioning the slide members 25*a*, 25*b* and 25*c*. The slide members 25*c* and 25*d* have holes 25*ch* and 25*dh* formed therein, so that the clasps 33*a* and 33*b*, which press the slide members 25*b* and 25*c* located at the left of the slide members 25*c* and 25*d*, can pass therethrough.

When the rod member 24 is pulled, the strand-like member 28 presses backwardly the slide member 25*a* located at the front end at a speed equal to twice the moving speed of the rod member 24. The other slide members 25*b* and 25*c* are also moved backwardly in a similar manner until the slide member 25*c* abuts the stationary slide member 25*d*. After the threading operation has been completed, the rod member 24 is pushed. Then, the clasps 29 and 33 sequentially press the slide members 25*a*, 25*b* and 25*c* until they abut the stops 34. Thus, the slide members 25*a*, 25*b*, 25*c* and 25*d* are spaced at a predetermined distance.

Figure 5:
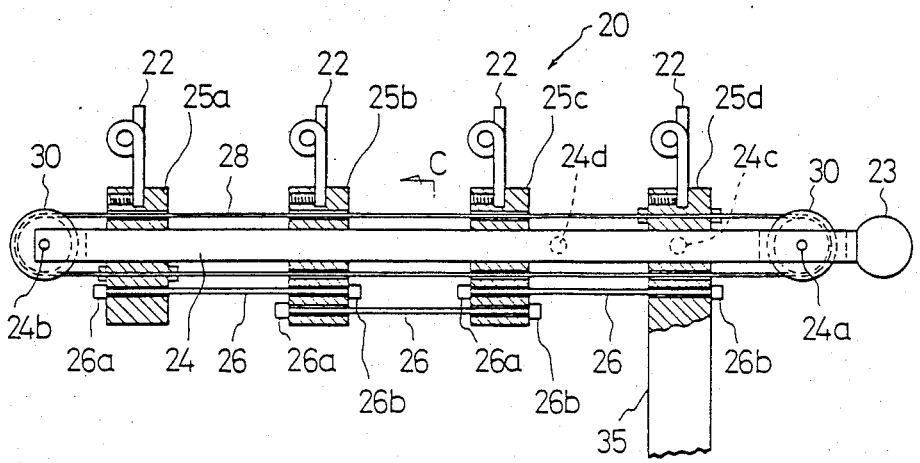

In the above-described embodiments, the slide members 25*a* and 25*c* move in the guide rail member 21. However, the guide rail member may be omitted by using the rod member 24 as a guide in place of the guide rail member as illustrated in FIG. 5. In this case, the slide member 25*d* is fixed to the machine frame 35 or formed in one body with the machine frame 35, and the slide members 25*a* to 25*c* can be slid along the rod member 24.

In order to prevent the slide members 25*a* to 25*c* and the yarn guides 22 from turning about the longitudinal axis of the rod member 24, the following methods can be applied.

Figure 6:
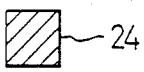
FIG. 6 is a cross sectional view of a rod member seen along arrow C in FIG. 5.

A. The cross section of the rod member 24 is formed in a polygon, such as a square as illustrated in FIG. 6, other than a circle or in an ellipse, and holes having a corresponding form to the cross section of the rod member 24 are formed in the slide members 25*a* to 25*d*.

B. The cross section of the rod member and the holes of the slide members are formed in a circle, pins for preventing their turning are formed on the slide members, and an elongated hole or holes engaging with the pins are formed in the rod member 24.

C. An axially extending projection or projections are formed on the rod member 24, and grooves engaging with the projections are formed in the slide members.

ADVANTAGES OF THE INVENTION

As described above, in the conventional device, when the yarn guide mounting bar is pulled, the end of the yarn guide mounting bar remarkably projects from the yarn guide box as designated by a dot and a dash line in FIG. 1. Thus, an operating space around the yarn guide box is narrowed. In order to overcome the above-described narrowing, a large operating space has to be spared so as to prevent operating ability from being decreased. There is another problem that the yarn guide mounting bar may be bent when the yarn guide bar, which has been pulled outwards, is pushed again into the guide box unless they are sufficiently in parallel with each other.

Contrary to this, according to the present invention, the yarn guide 22 located at the front end of the rod member 24 is moved a distance equal to or more than twice of the moving distance of the rod member 24 when the rod member 24 is moved. In other words, the rod member 24 has to be moved a distance equal to or less than a half of the moving distance of the yarn guide 22.

Thus, the rod member 24 does not project excessively from the front surface of the machine frame, and accordingly, the operating ability of an operator around the textile machine is increased, and the guide device for separating a plurality of yarn passages is not damaged while it is operated.

Further, according to the present invention, since the yarn guides 22 can be spaced at a predetermined distance when yarns are ordinary taken up, filaments constituting the yarns can be prevented from being entangled with neighboring yarns.

In addition, according to the present invention, since the yarn guides 22 can be close to each other when yarns are threaded thereonto, the yarn can be easily threaded onto the yarn guides 22.

What is claimed is:

1. A guide device for separating a plurality of yarns passages comprising:

a stationary member;

a rod member movable in a lengthwise direction thereof;

a plurality of slide members, provided with yarn guides and movable along said rod member;

said rod member having at least a pair of guide members, which sandwich said slide members therebetween;

a strand-like member wrapped around said guide members; and wherein said strand-like member is connected to one of said slide members and said stationary member.

2. A guide device for separating a plurality of yarn passages according to claim 1, further including a hollow cylindrical guide rail member; and wherein said rod member and said slide members are inserted into and movable along said hollow cylindrical guide rail member.

3. A guide device for separating a plurality of yarn passages according to claim 1, wherein connecting members (26) having engaging members (26*b*) at ends thereof are loosely inserted between adjacent slide members (25*a* and 25*b*, 25*b* and 25*c*, 25*c* and 25*d*).

4. A guide device for separating a plurality of yarn passages according to claim 3, wherein the distance between said engaging members (26*b*) of said connecting member (26) is equal to the sum of the distance between said yarn guides (22) under yarn passages separating condition and the thickness of said slide member (25*a*–25*d*).

5. A guide device for separating a plurality of yarn passages according to claim 1, further including a hollow cylindrical guide rail member; and wherein said rod member and said slide members are inserted into and movable along said hollow cylindrical guide rail member, said guide rail member has stops spacing a distance between said yarn guides under a yarn passage separating condition, and said strand-like member has clasps spacing a distance between said yarn guides under said yarn passages separating condition.

6. A guide device for separating a plurality of yarn passages according to claim 1, wherein said rod member, and said stationary member includes one of slide members secured to a machine frame.

7. A guide device for separating a plurality of yarn passages according to claim 6, wherein a cross section of said rod member (24) and shape of hole in said slide members (25*a*–25*d*) for inserting said rod member (24) are formed in a non-circular shape so as to prevent said relative rotation.

8. A guide device for separating a plurality of yarn passages according to claim 1, wherein said guide member (30) is a pulley rotatably supported on said rod member (24).

* * * * *